US007884549B2

(12) United States Patent
Scholler et al.

(10) Patent No.: US 7,884,549 B2
(45) Date of Patent: Feb. 8, 2011

(54) GAS-DISCHARGE LAMP

(75) Inventors: Klaus Scholler, Nideggen (DE); Manfred Westemeyer, Aldenhoven (DE); Godfried Maria Manders, Susteren (NL); Bram Visser, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 212 days.

(21) Appl. No.: 12/307,774

(22) PCT Filed: Jun. 28, 2007

(86) PCT No.: PCT/IB2007/052513

§ 371 (c)(1),
(2), (4) Date: Jan. 7, 2009

(87) PCT Pub. No.: WO2008/007283

PCT Pub. Date: Jan. 17, 2008

(65) Prior Publication Data

US 2009/0289551 A1 Nov. 26, 2009

(30) Foreign Application Priority Data

Jul. 7, 2006 (EP) ..... 06116768

(51) Int. Cl.
*H01J 61/36* (2006.01)
*H01J 9/18* (2006.01)

(52) U.S. Cl. ..... 313/623; 313/25; 313/607; 313/594; 313/234; 313/634; 445/33; 445/43; 445/26

(58) Field of Classification Search ..... None
See application file for complete search history.

(56) References Cited

U.S. PATENT DOCUMENTS

| | | | | |
|---|---|---|---|---|
| 3,662,203 | A * | 5/1972 | Kuhl et al. | 313/25 |
| 5,541,480 | A | 7/1996 | Renardus et al. | |
| 6,172,462 | B1 | 1/2001 | Gibson et al. | |
| 6,294,870 | B1 | 9/2001 | Kawashima et al. | |
| 6,538,377 | B1 | 3/2003 | Scott et al. | |

(Continued)

FOREIGN PATENT DOCUMENTS

DE 19610387 A1 9/1997

(Continued)

*Primary Examiner*—Ashok Patel

(57) ABSTRACT

A gas-discharge lamp (1) is described having an inner envelope (2) comprising a discharge vessel (3) and two tubular sections (6, 7) arranged on the discharge vessel, having two electrodes (4, 5) that project from the tubular sections (6, 7) into the discharge vessel (3) and that, to enable them to be supplied with power, are electrically connected to respective electrical conductors (10, 11) that extend through the associated tubular sections (6, 7) and that are enclosed in the tubular sections (6, 7) with a gastight seal along a sealing section (8, 9). The lamp (1) has an outer envelope (18) that is connected at each of its ends to respective ones of the tubular sections (6, 7) of the inner envelope (2) and that surrounds the discharge vessel (3) while leaving an outer cavity (20) between itself (18) and the discharge vessel (3). Arranged on the outside of the inner envelope (2), at least in a region or regions, is a conductive coating (22, 23) that is conductively connected, inside the outer envelope (18), to one (11) of the electrical conductors. Also described is a corresponding method of producing a gas-discharge lamp (1).

12 Claims, 3 Drawing Sheets

U.S. PATENT DOCUMENTS

| | | | | |
|---|---|---|---|---|
| 7,550,925 | B2 * | 6/2009 | Lesch et al. | 313/635 |
| 7,612,503 | B2 * | 11/2009 | Bittmann et al. | 313/634 |
| 2009/0230876 | A1 * | 9/2009 | Tamai et al. | 315/291 |
| 2010/0060183 | A1 * | 3/2010 | Tamai | 315/246 |

FOREIGN PATENT DOCUMENTS

| | | | |
|---|---|---|---|
| EP | 0938127 | A1 | 8/1999 |
| EP | 0990248 | B1 | 4/2000 |
| EP | 1069596 | A2 | 1/2001 |
| EP | 1169728 | B1 | 1/2002 |
| EP | 1355345 | A1 | 10/2003 |
| EP | 1632985 | A1 | 3/2006 |
| GB | 987939 | A | 3/1965 |
| JP | 05105979 | A | 4/1993 |
| JP | 06060851 | A | 3/1994 |
| JP | 10134773 | A | 5/1998 |
| WO | 0173817 | A1 | 10/2001 |
| WO | 0237533 | A2 | 5/2002 |
| WO | 2004083900 | A2 | 9/2004 |

* cited by examiner

GAS-DISCHARGE LAMP

The invention relates to a gas-discharge lamp having an inner envelope comprising a discharge vessel and two tubular sections arranged on the discharge vessel, from which tubular sections there project, into the discharge vessel, electrodes that, to enable them to be supplied with power, are electrically connected to respective electrical conductors that extend through the associated tubular sections and that are enclosed in the tubular sections with a gastight seal along a sealing section. This gas-discharge lamp also has an outer envelope that is connected at each of its ends to respective ones of the tubular sections of the inner envelope and that surrounds the discharge vessel while leaving an outer cavity between itself and the discharge vessel. The invention also relates to a method of producing a gas-discharge lamp of this kind.

Gas-discharge lamps constructed in the manner specified in the opening paragraph are often what are termed high-pressure gas-discharge lamps, such for example as high-pressure sodium lamps or particularly MPXL (Micro Power Xenon Light) lamps, or in particular corresponding mercury-free high-pressure gas-discharge lamps. In all these lamps, the discharge vessel (normally also referred to as the "burner") contains only a few micro-liters of gas. The effectiveness of such lamps with regard to the production of light is all the higher the higher is the pressure of the inert gas present in the discharge vessel. Unfortunately, a higher pressure for the inert gas means that it becomes more difficult to ignite a discharge in the gas. Because a preferred use for lamps of this kind is in motor-vehicle headlamps, it is necessary, for safety reasons, for the lamps to start reliably within a very short time of being switched on. Therefore, to ensure reliable starting both in the cold state and in the hot state, e.g. when a fresh start is to take place shortly after the lamp has been switched off, relatively high igniting voltages have to be applied. This calls for igniter circuits that are relatively powerful and complicated and thus more expensive and large in size. Also, a higher igniting voltage accentuates the problem of the electromagnetic interference caused by the lamp in other electronic components of the vehicle's electronic system. More energetic steps therefore also have to be taken to screen off or prevent the electromagnetic interference pulses caused by the starting processes.

It has already been known for quite some time that the igniting voltage in high-pressure discharge lamps can be appreciably reduced with the help of a device that is generally termed a "starting-aid antenna". In this way, there are described in, for example, EP 1 069 596 A2 antennas that are run along the discharge vessel or are looped around it and to which a positive potential is applied. What this gives is a sort of auxiliary electrode that is intended to cause an increase in the electrical field in the interior of the discharge vessel. "Active" antennas of this kind, which are raised to a given potential for ignition, are generally relatively complicated in design and are therefore often too expensive for mass production A less expensive solution to the problem of providing an active antenna as close as possible to the burner would be for a conductive coating to be applied to the inner envelope, at least in a region or regions. However, there is then a problem in connecting this conductive layer to a suitable conductor to enable a voltage pulse to be supplied to the active antenna at the right point in time for ignition. In production engineering terms, what has to be taken into consideration in this case is that the inner envelope is in fact, as described above, surrounded by an outer envelope. The main purpose of this outer envelope is to absorb the ultraviolet radiation that, amongst other things, is produced by the discharge. However, the outer envelope too is often sealed off from the ambient atmosphere and filled with a particular gas—possibly even with air or synthetic air—generally at a pressure lower than ambient pressure. The use of a sealed, gas-filled outer envelope of this kind has the advantage that the temperature of the inner envelope and hence, indirectly, the luminous flux from, and life of, the lamp can be acted on by way of the gas filling. In modern-day quite small high-pressure discharge lamps the outer envelope is usually connected at each end to the tubular sections of the inner envelope at what is termed the "roll-on" at that end of the sealing section that points away from the discharge vessel. The fastening of the outer envelope to the inner envelope thus takes place when the inner envelope is already fully filled and sealed. In process engineering terms, the making of a connection to a conductive coating on the inner envelope in a lamp of this kind is extraordinarily difficult and involves a high scrap-rate and is therefore relatively costly. It is true that the coating could, in principle, simply be continued along the tubular section and run through the roll-on. However, the problem that would arise if this were done is that the majority of cheap coating materials are not sufficiently stable at high temperatures to withstand the process of attaching the outer envelope, which takes place at temperatures of approx. 1,900° C. The insertion of a wire through the outer envelope has also proved to be very difficult mechanically. For this, a wire run along the outside of the glass tubular sections of the inner envelope would have to be specially protected when the outer envelope was fitted or the additional risk would arise that, in the rolling-on process or during operation, the outer envelope would be stressed by the stresses generated mechanically in the glass as a result of thermal expansion. Even the introduction of a wire of this kind only after the outer envelope had been fitted would be extremely problematic because of the difficulty there would be in running it through the outer envelope and in positioning it exactly in the outer envelope and connecting it to the coating.

It is therefore an object of the present invention to provide an alternative to the gas-discharge lamps known in the prior art and one that can be produced with little cost and effort and that starts reliably even at reduced igniting voltages, and to specify a corresponding method of producing a gas-discharge lamp of this kind.

This object is achieved, on the one hand, by a gas-discharge lamp as claimed in Claim 1 and, on the other hand, by a method of producing a gas-discharge lamp as claimed in Claim 9.

In the high-pressure gas-discharge lamp according to the invention, there is, on the outside of the inner envelope, at least in a region or regions, a conductive coating that is conductively connected, inside the outer envelope, to an electrical conductor running to the electrodes—preferably the supply conductor to which the starting pulse is applied.

The following advantages are achieved with an active antenna of this form:

On the one hand, the effect of a conductive coating is greater than, for example, that obtained with an antenna wire, because the connection between the coating and the glass parts of the envelope is stronger. A coating of this kind directly onto the glass of the inner envelope also has the advantage that the antenna is very close to the electrodes and the willingness to ignite is thus improved to an even greater degree than with an antenna wire. Also, the undesirable diffusion of sodium out of the quartz glass that occurs in the region of the antenna with a quartz glass envelope is less with a conductive coating than it is with an antenna wire.

On the other hand, the production process is unusually simple because the coating can be applied inexpensively by a dipping process or stamping process or a spraying-on process or the like—followed if required by fixing processes by, for example, suitable thermal treatment. Because the connection to the supply wire is made inside the outer envelope, preferably in the region of the associated tubular section, nothing extra has to be run through from the outer envelope. The method can thus be easily and cheaply employed for envelopes of any desired geometry, with only slight changes having to be made to existing production processes for the lamps.

In a correspondingly inexpensive method of producing a high-pressure gas-discharge lamp, the following method steps, amongst others, are progressed through:

An inner envelope comprising a discharge vessel and two tubular sections arranged on the discharge vessel is first produced.

The introduction then takes place of two electrodes that project from the tubular sections into the discharge vessel, which electrodes, to enable them to be supplied with power, are electrically connected to respective electrical conductors that extend through the associated tubular sections, and the discharge vessel is filled with the desired filling materials, such for example as mixtures of inert gases, metal halides, mercury if required, etc. and the electrical conductors are enclosed in an appropriate way in the respective tubular sections with a gastight seal along a respective sealing section. There is a range of possible methods of performing this process. In this way, one electrode may for example be introduced first and a first pinch, or the like, may be made on the side concerned to seal in the electrical conductor concerned. The filling materials may then be fed in, the second electrode inserted and the inner envelope closed off with an airtight seal on the second side. Certain flushing and de-gassing steps are generally necessary in this case to decontaminate the inner envelope and the filling materials and electrodes that are to be introduced. However, the enormous variety of different methods of producing, filling and sealing-off lamp envelopes are familiar to the person skilled in the art and there is therefore no need for them to be explained in detail here.

In accordance with the invention, a conductive coating is then applied to at least one region on the outside of the inner envelope and the coating is connected electrically to an electrical conductor, preferably in the region of the associated tubular section. Particularly advantageous methods that may possibly be employed for this purpose will be elucidated in detail below.

Finally, the outer envelope can then be attached to the tubular sections of the inner envelope in the usual way so that the outer envelope encloses the discharge vessel while leaving a cavity between itself and the discharge vessel, in which case appropriate care must be taken to see that the point at which the outer envelope is attached to the tubular section is outside the electrical connection between the conductive coating and the electrical conductor in the tubular section.

The dependent claims and the remainder of the description each cover particularly advantageous embodiments and refinements of the invention. In this case, the method of producing the gas-discharge lamp may in particular be arranged to follow the dependent claims of the gas-discharge lamp and, conversely, the gas-discharge lamp may be formed in accordance with the dependent claims of the method of production.

As a particular preference, the conductive coating is electrically connected to the electrical conductor simply through a hole that projects from the cavity between the outer envelope and inner envelope into the tubular section and to the electrical conductor. The hole in question may be a small circular hole but it may also be a hole or piercing of any other desired shape. A suitable hole therefore has to be made in the tubular section associated with the relevant electrical conductor in the production process, and the conductive coating then has to be electrically connected to the electrical conductor through the hole. The making of a hole in the tubular section may take place in various ways. In this way, the hole may be bored or, by a preferred method, may be made in the tubular section with a laser. By another, more inexpensive, method, the hole is simply impressed at the same time during a pinching process in which the sealing section is produced in the tubular section.

When the tubular section has a hole of this kind, the coating merely has to be run along the tubular section to the hole, and the hole can simply be filled with the material from which the coating is formed, such for example as a conductive ink or the like.

As has already been described above, it may be advantageous in many applications if the outer cavity between the outer envelope and the inner envelope is sealed off from the surrounding air to enable, for example, the light from, current to, and life of, the lamp to be acted on by means of a special filling gas. Suitable filling gases are for example xenon, krypton, argon and neon (which cools particularly well) or synthetic air i.e. air containing an 80% proportion of nitrogen and a 20% proportion of oxygen, because, unlike atmospheric air, synthetic air does not contain any contaminating water, or pure nitrogen or pure oxygen (which cool particularly well) or mixtures of the said gases in other proportions. The pressure in the cavity between the inner and outer envelopes should be between 10 mbar and 100 mbar, and preferably between 10 mbar and 300 mbar, in this case.

When a lamp of this kind is to be produced with a sealed outer envelope, it is necessary for the connection between the coating and the supply conductor to be made in such a way that a point does not arise at which there is not a seal. In the variant described above, where a hole is made in the tubular portion to the electrical conductor situated within it and the electrical conductor is connected to the coating through this hole, the hole is therefore preferably situated in the region of the sealing section. As a particular preference, it is also ensured that the electrical conductor is formed, in the region of the hole, by a metal strip, such as a molybdenum foil for example. In the sealing sections, the electrical supply conductors to the electrodes usually comprise a molybdenum foil anyway. What this means is that the electrodes are for example first connected to molybdenum foils that, at the outer end, are connected in turn to molybdenum wires or the like that then serve as connections outside the lamp. The seal in the tubular section is made in this case in such a way that the molybdenum foil is completely enclosed in the sealing section.

Because the discharge vessel becomes very hot in operation, it is preferable for the hole in the sealing section to be as far away as possible from the discharge vessel to prevent the point of contact from becoming oxidized if there is oxygen or water present in the filling of the outer envelope. The hole in the sealing section should therefore preferably be spaced at least 12 mm and, as a particular preference, at least 15 mm away from the tip projecting into the discharge vessel of the electrode that is connected to the electrical conductor concerned, i.e. from the discharge arc. To achieve this, a metal strip that is longer than usual and that is of a length of for example at least 10 mm and preferably at least 12 mm may simply be connected to the relevant end of the electrode.

An alternative, to bring the point of contact closer to the discharge vessel, is for the current-carrying material to be entirely covered by the coating, so that it is unable to oxidize at quite high temperatures even if there is oxygen present.

In an alternative variant, the electrical conductor at this end of the electrode is formed, in two sections spaced apart from one another, by portions of metal strip. What this means is that the electrical conductor used is one that is composed, at the electrode end, of a first portion of metal strip that is connected directly to the electrode. At the end pointing away from the electrode, a metal wire is connected in the usual way to this portion of metal strip. However, this metal wire is relatively short and is connected in turn to a portion of metal strip that, at the outer end, is finally connected in turn to a metal wire that, in the end, acts as a contact outside the lamp. Two sealing sections that cover the two portions of metal strip are then made at this end of the electrode. Alternatively, one continuous sealing section may also be made, which is sufficiently long to cover both the portions of metal strip. The seal can be made in both cases by a pinching process or by a vacuum process. In the case of an electrical conductor of this design, the hole is then preferably made in the sealing section at the portion of metal strip further away from the discharge vessel or in the region of the wire between the portions of metal strip. Molybdenum is preferably once again used as the material for the portions of metal strip and the metal wires.

A vast variety of materials can be used for the coating. What suggest themselves in particular are materials such as ATO (antimony tin oxide) or ITO (indium tin oxide). In principle however, any other conductive coating (metals, e.g. tungsten, platinum, etc.) may also be applied that is sufficiently stable at high temperatures and that is chemically inert to the atmosphere in the outer envelope so that it will survive the normal operation of the lamp undamaged. Suitable methods of coating are sufficiently well known to the person skilled in the art.

With regard to the geometrical form of the coating on the inner envelope, there are also various possibilities, though this of course depends on whether, as in the case of the materials mentioned above, the coating materials are transparent or whether they are opaque materials such for example as more straightforward metallizing. Thus, when for example a material transparent to light is used, the entire inner envelope may preferably be coated. This has the advantage that the coating can be very satisfactorily performed by the dipping process. Also, depending on the type of lamp, better EMI (electromagnetic interference) characteristics can be obtained in this way. Equally, it is however also possible for a strip of coating extending, for example, longitudinally across the envelope or a ring extending around the electrode to be applied to the envelope. Any other desired geometries may also be employed, the preferred geometries being ones where the effect on the luminous flux from the lamp is not too great.

The invention is particularly well suited to the preferred high-pressure gas-discharge lamps specified at the beginning because the improvement in ignition achieved with an antenna of this kind is all the greater the higher are the breakdown voltages required. This being the case, the greatest effect is achieved in the high-pressure gas-discharge lamps specified at the beginning. As well as this, the invention can however also be advantageously applied to other gas-discharge lamps. What is more, the invention is particularly suitable for lamps for the automobile industry. However, advantageous use is also possible in lamps for other purposes, such as lamps for projection systems for example.

These and other aspects of the invention are apparent from and will be elucidated with reference to the embodiments described hereinafter. The same components are identified in the drawings by the same reference numerals. It is explicitly pointed out that the drawings are only schematic and are not true to scale.

Figure 1:
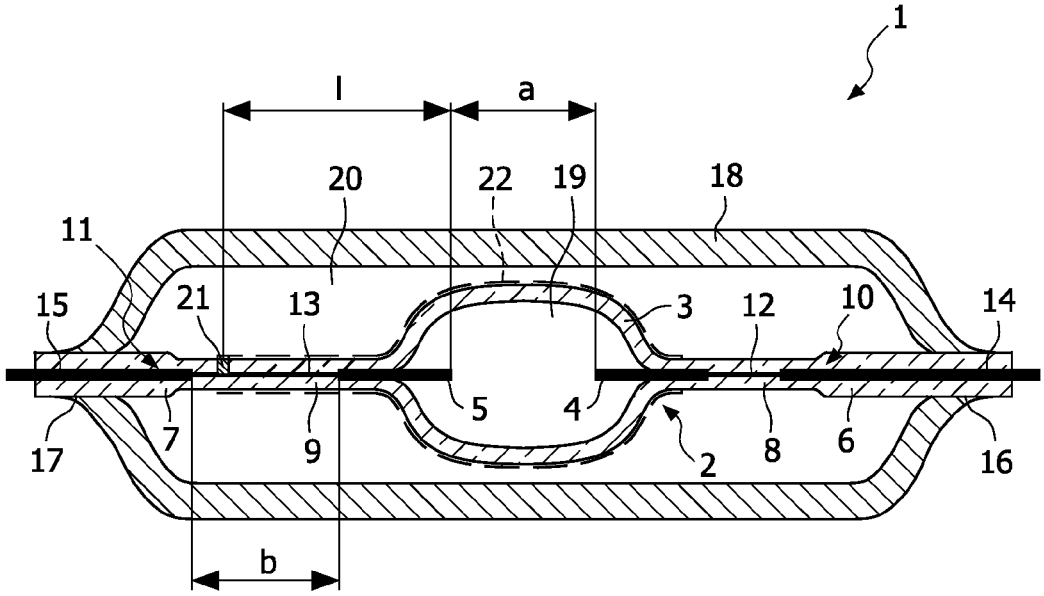
FIG. 1 is a section through a first embodiment of a gas-discharge lamp according to the invention.
Figure 2:
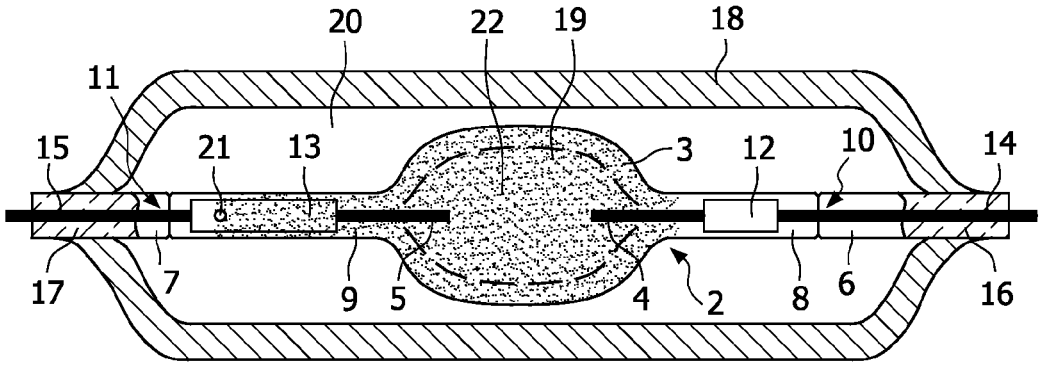
FIG. 2 is a plan view, in section through the outer envelope, of the gas-discharge lamp shown in FIG. 1.

The embodiment shown in FIGS. 1 and 2 is, without the invention being limited thereto, an MPXL lamp that is preferably used and that is constructed in the usual way to have an inner envelope 2 and an outer envelope 18 surrounding the said inner envelope 2.

The inner envelope 2 comprises in this case the actual discharge vessel (burner) 3 of quartz glass that has tubular sections 6, 7 integrally formed on the discharge vessel 3 at respective ones of two opposing ends thereof. These tubular sections 6, 7 will also be referred to in what follows as "quartz glass end-pieces". Respective electrodes 4, 5 project from these quartz glass end-pieces 6, 7 into the discharge vessel 3.

The optical distance a between the tips of the electrodes is 4.2 mm. In the sealing sections 8, 9, the electrodes 4, 5 are connected to respective electrical conductors 10, 11 that project out of the quartz glass end-pieces 6, 7 at the ends thereof and act, on the outside, as contacts. These electrical conductors 10, 11 firstly comprise a relatively thin metal strip 12, 13, such for example as a molybdenum foil, which is connected to the electrode 4, 5 at one end and, at the other end, is connected in turn to a supply wire 14, 15 that finally projects from the quartz glass end-piece 6, 7, on the outside. The supply wire 14, 15 may for example be a molybdenum wire. In the region of the metal strips 8, 9, the quartz glass end-pieces 6, 7 take the form of sealing sections 8, 9 that enclose the metal strip 12, 13 concerned with a seal. This seal may for example be made in the usual way by pinching the relevant quartz glass end-piece 6, 7. The sealing sections 8, 9 are therefore also usually referred to as "pinches". It is ensured in this way that the discharge vessel 3 is sealed off from the surroundings with an airtight, or rather gastight, seal.

In the interior 19 of the discharge vessel 3 is the inert gas at a relatively high pressure. Because of this inert gas, a discharge arc forms between the two electrodes 4, 5 when the lamp 1 ignites and can then be maintained, in steady-state operation, by a voltage that is very low in relation to the igniting voltage. In conventional lamps, the igniting voltage is usually of the order of 16 to 25 kV and the operating voltage for the steady-state range is 40 to 100 volts. In the embodiment shown in the drawings, the ignition voltage is in each case applied to the electrical conductor 11 shown on the left of the drawings.

The inert gas may in principle be any desired inert gas that is normally used. Similarly, the lamp may also contain mercury. However, the greatest improvement in willingness to ignite is achieved particularly in mercury-free lamps because it is in these lamps that ignition is generally an even greater problem than in mercury-containing lamps. From another aspect, mercury-free lamps are to be preferred for environmental reasons. It is therefore particularly preferred for the invention also to be used in mercury-free lamps.

The chief purpose of the outer envelope 18 is to screen off the UV radiation that, due to the physical processes in the discharge vessel, occurs in addition to the desired spectrum of light. The said outer envelope 18 is usually likewise manufactured from quartz glass and is connected at the ends to the quartz glass end-pieces 6, 7 of the inner envelope 2 at what are termed the roll-ons 16, 17. These roll-ons 16, 17 are likewise made in such a way as to be gastight and the gap 20 between the inner envelope 2 and the outer envelope 18 is filled with a gas or a mixture of gases, even with air if required, as has already been described above.

The lamp 1 is generally held in a cap (not shown) at the end that has the supply conductor 11 for the igniting voltage. The gas-discharge lamp 1 is generally connected solidly to the cap by means of a suitable mounting in this case and forms with it a common lamp unit. The conductor 10 connected to the electrode 4 situated further away from the cap is generally connected to an external electrical return conductor (not shown) that runs back to the cap past the outer envelope 18. A lamp unit of this kind can be used in a vast variety of lights that have a suitable receptacle to hold the cap and in particular in motor vehicle headlamps.

To improve the willingness of the lamp 1 to ignite, the discharge vessel 3 is completely coated, in the embodiment shown in FIGS. 1 and 2, with a transparent conductive coating, of for example ITO or ATO. This coating 22 is electrically connected to the electrical conductor 11 to which the voltage pulse for igniting the lamp 1 is applied. For this purpose, a hole 21, which runs from the interior 20 of the outer envelope 18 through the quartz glass of the sealing section 9 and to the metal strip 13, is made in the sealing section 9. In the coating process, this hole 21 is simply filled with the coating material, thus producing sufficiently good contact between the metal strip 9, i.e. the electrical conductor 11, and the coating 22.

The making of the hole 21 in the region of the sealing section 9 over the metal strip 13 has two advantages. On the one hand it ensures that, despite the hole 21, the sealing section 9 is still sealed in both directions, i.e. both in relation to the interior 19 of the discharge vessel 3 and in relation to the outside environment. On the other hand, there is then a relatively wide area of metal present in the region of the hole 21 and the connection made between the conductive layer 22 and the electrical conductor 11 is thus relatively good.

Because the discharge vessel 3 becomes very hot in operation, the hole 21 is preferably made in the sealing section 9 at a relatively long distance from the discharge vessel 3. For this purpose, the sealing section 9 concerned on the side on which the electrical conductor 11 carrying the igniting pulse is situated is formed to be somewhat longer than on the other side, or in other words a longer metal strip 13, as appropriate, is used at this point. The length b of the metal strip 13 is approximately 15 mm in the present case. Otherwise, molybdenum strips of a length of only approximately 7 mm are generally used in such lamps, as shown on the side on which the other electrode 4 is situated. Because of this longer metal strip 13, it is possible for the hole 21 to be arranged over the metal strip 13 at a distance 1 of, for example, approx. 15 mm from the tip of the electrode 5 concerned, i.e. from what will later be the discharge arc.

Figure 3:
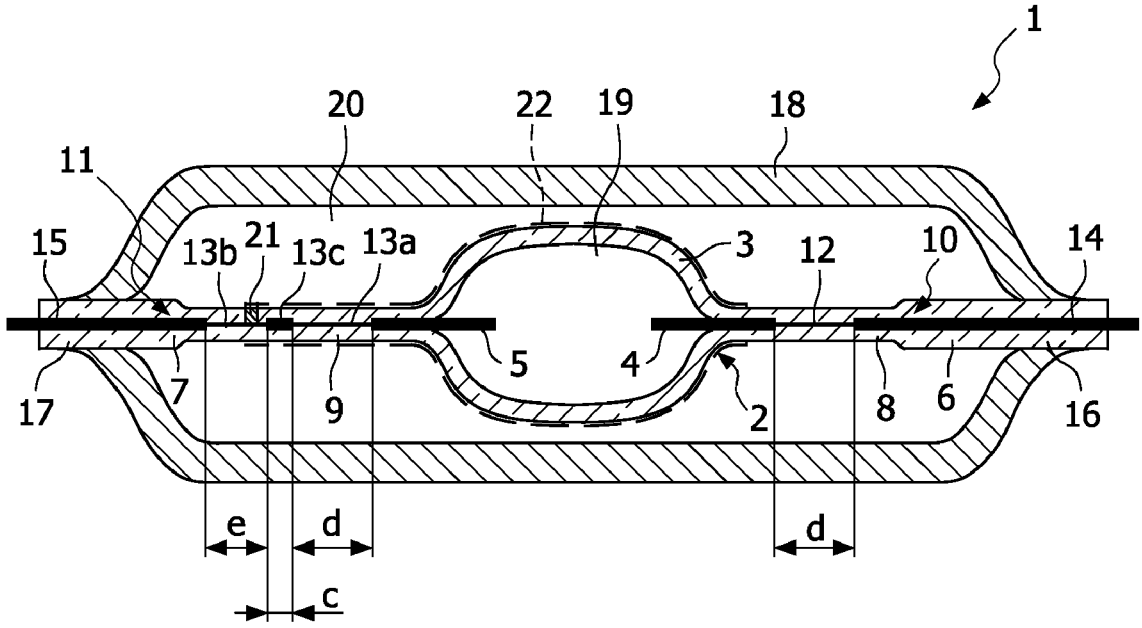
FIG. 3 is a section through a second embodiment of a gas-discharge lamp according to the invention.
Figure 4:
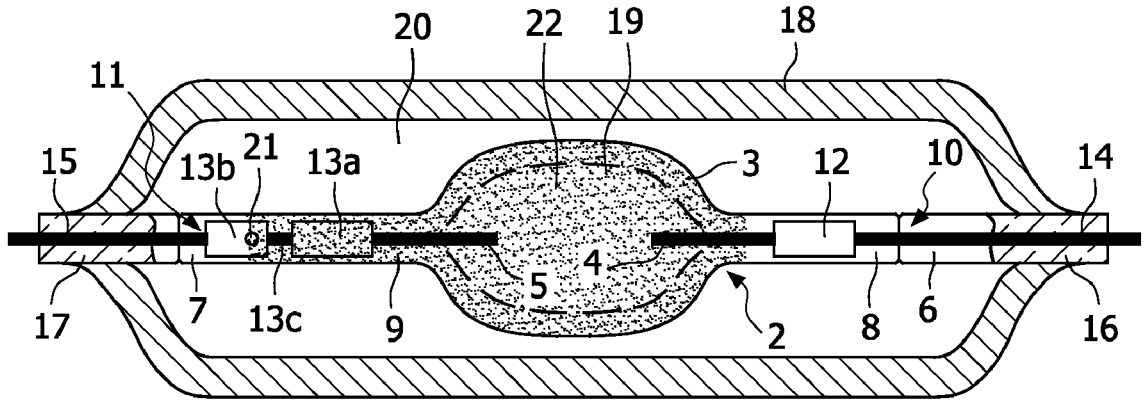
FIG. 4 is a plan view, in section through the outer envelope, of the gas-discharge lamp shown in FIG. 3.

FIGS. 3 and 4 show a slightly modified variant of the lamp 1. In principle, the lamp 1 is constructed in this case in an absolutely identical way to the lamp shown in FIGS. 1 and 2. The only way in which the design differs slightly is in the actual form taken by the electrical conductor 11 in the region of the sealing section 9 situated on the same side as the electrode 5 to which the igniting pulse is applied.

What are used at this point in place of a lengthened metal strip 13 (as in FIGS. 1 and 2) are two portions of metal strip 13*a*, 13*b* that are connected together by means of a metal wire 13*c*, preferably a molybdenum wire. The hole 21 is then made over the portion 13*b* of metal strip that is situated further out.

The sealing section 9 can be produced in two stages in this case, i.e. a pinch is for example first made around the portion 13*a* of metal strip near to the electrode and a second pinch is then made around the portion 13*b* of metal strip situated further out. In this case too, the distance between the hole 21 and the tip of the electrode is approx. 15 mm in one embodiment. A normal molybdenum strip of a length of, for example, 7.25 mm, such as is also used on the electrical conductor 10 arranged on the side on which the other electrode 4 is situated, may be used as the portion 13*a* of metal strip close to the electrode. The second portion 13*b* of metal strip may then be of a length of, for example, 6 mm and the piece of metal wire 13*c* situated in between may be of a free length of approximately 2 mm.

Figure 5:
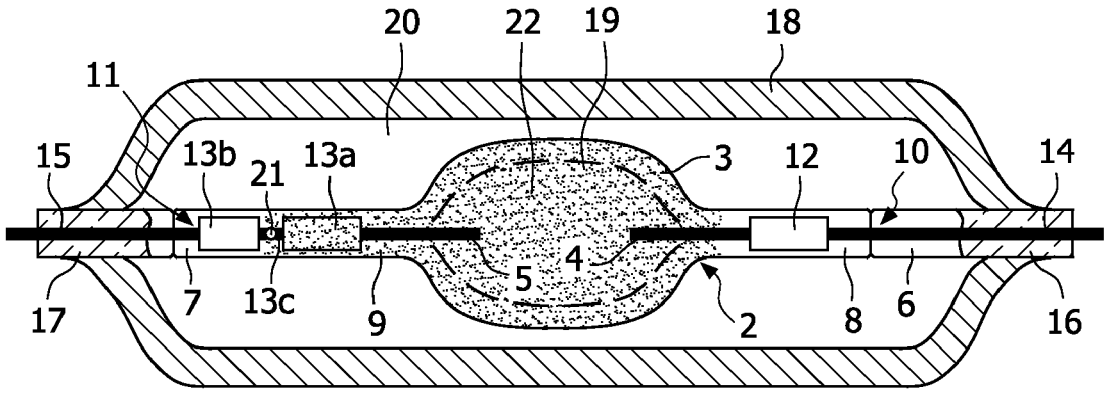
FIG. 5 is a plan view, in section through the outer envelope, of a third embodiment of a gas-discharge lamp according to the invention.

FIG. 5 shows a similar variant to FIGS. 3 and 4, with the hole being situated over the metal wire in this case and the distance between the hole 21 and the tip of the electrode being approx. 13 mm. This variant may have advantages from the process engineering point of view with regard to the making of the hole.

Figure 6:
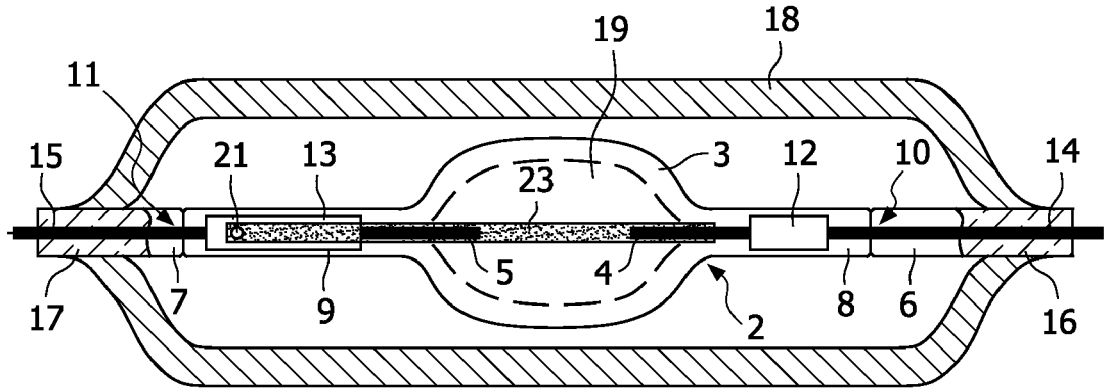
FIG. 6 is a plan view, in section through the outer envelope, of a fourth embodiment of a gas-discharge lamp according to the invention.

FIG. 6 shows yet another variant, which differs from the embodiment shown in FIGS. 1 and 2 merely in that in this case it is not the entire discharge vessel 3 that is provided with a coating 22 and instead it is simply a thin strip 23 of conductive material that is run across the discharge vessel 3 in the longitudinal direction of the lamp 1, starting from the hole 21. This variant suggests itself for use when for example it is a non-transparent coating material that is going to be used. This strip of coating 23 is then preferably arranged on the side on which the return conductor is also run along the outside of the outer envelope 18, which means that the effect on the optics of the lamp is unusually small.

The Table below gives some measured values that show that considerably better igniting behavior by the lamp can be achieved with the help of the invention.

The lamps numbered 1 to 10 were in each case quartz glass lamps having an inner envelope that had been coated over its full area and that, as shown in FIGS. 1 and 2, was connected to the supply conductor 11 of the electrode 5 to which the igniting pulse was applied. The lamps 1 used for the measurements concerned were D4Rs having a rated power of 35 watt. The optical distance between the electrodes was approx. 4.2 mm. The outside diameter of the outer envelope was 8.7 mm and its wall thickness 1 mm, and the outside diameter of the inner envelope was 6.1 mm and its wall thickness approx. 1.7 mm. The volume of the discharge vessel was approx. 20 μl in this case. The filling comprised various metal salts. The pressure in the inner envelope of the lamp was approx. 10 bar. The outer envelope had a sealed connection to the inner envelope in this case. The filling in the interior of the outer envelope comprised synthetic air. The pressure in the interior of the outer envelope was approx. 100 mbar.

For comparison purposes, the lamps numbered 11 and 12 were lamps that were of the same construction as the lamps numbered 1 to 10 but in which the outer envelope was not fastened to the inner envelope with a seal against the ambient air, i.e. in which the interior of the outer envelope was filled simply with ambient air.

| Lamp no. | Averages Pulses | Averages KV |
|---|---|---|
| 1 | 1.0 | 10.93 |
| 2 | 1.0 | 12.33 |
| 3 | 1.0 | 11.47 |
| 4 | 1.0 | 11.93 |
| 5 | 1.0 | 11.73 |
| 6 | 1.0 | 11.07 |
| 7 | 1.0 | 13.00 |
| 8 | 1.0 | 10.87 |
| 9 | 1.0 | 12.93 |
| 10 | 1.0 | 14.73 |
| Average: | 1.0 | 12.10 |
| 11 | 1.0 | 13.40 |
| 12 | 1.0 | 12.87 |
| Average: | 1.0 | 13.14 |
| 13 | 2.3 | 18.07 |

Shown in the Table are the averages of more than one measurement made on, respectively, the lamps numbered 1 to 10 (sealed outer envelope) and the lamps numbered 11 and 12 (non-sealed outer envelope).

The line for the lamp numbered 13 is the average of measurements made on normal reference lamps that were of the same construction but did not have a coating coupled, in accordance with the invention, to the supply conductor.

As this Table clearly shows, considerably better igniting behavior is obtained with the help of the conductive coating 22 that is connected, in accordance with the invention, to the supply conductor 11 for the electrode 5 to which the igniting pulse is applied, this being the case even when the outer envelope 18 is not sealed and is thus filled with ambient air. Whereas an average of 2.3 igniting pulses were required in the conventional reference lamps and, in this case, an average firing voltage of 18.07 kV had to be applied, a lamp according to the invention having an outer envelope accessible to the ambient air ignited even with an average igniting voltage of 13.14 kV, with only one igniting pulse being required to ignite the lamp reliably. Even better results were achieved when the outer envelope was closed with a seal. In this case an average igniting voltage of 12.1 kV was all that was required.

However, as the results also show, the igniting voltages required for the lamps actually used in any given case may be very different both in the case of the types having a sealed outer envelope and in the case of those having a non-sealed outer envelope. What this means is that how high the igniting voltage required actually is depends in each case on the actual lamp. It must be borne in mind in this case that what are shown in the last column in the Table are themselves average values over a plurality of ignitions of the lamp. As can be seen from the Table, the maximum igniting voltages required are not very different between the type having a sealed outer envelope and the one having a non-sealed outer envelope.

To ensure that ignition takes place reliably at the first igniting pulse, it makes good sense for the igniting voltage provided to be, basically, one that is above the maximum value that has been found. However, if a suitable circuit is used, then, as far as willingness to ignite is concerned, a lamp in accordance with the invention having a non-sealed outer envelope may be used just as satisfactorily as a lamp according to the invention having a sealed outer envelope. However, as has already been described above, the use of a sealed outer envelope has the further advantage that a positive influence may be exerted on the luminous flux from the lamp and its life by means of suitable gas fillings.

To conclude, it will again be pointed out that the lamps and methods actually shown and described in the drawings and the description are illustrative embodiments that may be varied by the person skilled in the art over a wide range without exceeding the scope of the invention. For safety's sake, it will also be pointed out that the use of the indefinite article "a" or "an" does not rule out the possibility of the feature concerned being present more than once.

The invention claimed is:

1. A gas-discharge lamp (1) having an inner envelope (2) comprising a discharge vessel (3) and two tubular sections (6, 7) arranged on the discharge vessel, two electrodes (4, 5) that project from the tubular sections (6, 7) into the discharge vessel (3) and that, to enable them to be supplied with power, are electrically connected to respective electrical conductors (10, 11) that extend through the associated tubular sections (6, 7) and that are enclosed in the tubular sections (6, 7) with a gastight seal along a sealing section (8, 9), an outer envelope (18) that is connected at each of its ends to respective ones of the tubular sections (6, 7) of the inner envelope (2) and that surrounds the discharge vessel (3) while leaving an outer cavity (20) between itself and the discharge vessel (3), and a conductive coating (22, 23) that is arranged on the outside of the inner envelope (2) at least in a region or regions and that is conductively connected, inside the outer envelope (18), to one (11) of the electrical conductors.

2. A gas-discharge lamp as claimed in claim 1, characterized in that the coating (22, 23) is electrically connected to the electrical conductor (11) through a hole (21) that projects from the outer cavity (20) into the associated tubular section (7) and to the electrical conductor (11).

3. A gas-discharge lamp as claimed in claim 2, characterized in that the coating (22, 23) is run along the tubular section (7) to the hole (21) and the hole (21) is filled with the material of which the coating (22, 23) is formed.

4. A gas-discharge lamp as claimed in claim 2, characterized in that the hole (21) is situated in the tubular section (7) in the region of the sealing section (9) or between two sealing sections that are formed in the relevant tubular section (7).

5. A gas-discharge lamp as claimed in claim 2, characterized in that the electrical conductor (11) is formed by a metal strip (13, 13*b*) in the region of the hole (21).

6. A gas-discharge lamp as claimed in claim 5, characterized in that, in two sections spaced apart from one another, the electrical supply conductor (11) is formed by portions of metal strip (13*a*, 13*b*) that are connected together by a metal wire (13*c*), and the hole (21) is situated in the tubular section (7) at the portion (13*b*) of metal strip situated further from the discharge vessel (3) or at the metal wire (13*c*) situated between the portions of metal strip (13*a*, 13*b*).

7. A gas-discharge lamp as claimed in claim 1, characterized in that the conductive coating (22) comprises a transparent material.

8. A gas-discharge lamp as claimed in claim 1, characterized in that the outer cavity (20) is sealed off from the ambient air.

9. A method of producing a gas-discharge lamp (1) having the following method steps:

production of an inner envelope (2) having a discharge vessel (3) and two tubular sections (6, 7) arranged on the discharge vessel (3), introduction of two electrodes (4, 5) that project from the tubular sections (6, 7) into the discharge vessel (3), which electrodes (4, 5), to enable them to be supplied with power, are electrically connected to respective electrical conductors (10, 11) that extend through the associated tubular sections (6, 7), and filling of the discharge vessel (3) with the desired filling materials and enclosure of the electrical conductors (10, 11) in the respective tubular sections (6, 7) with a gastight seal along a sealing section (8, 9), application of a conductive coating (22, 23) to at least one region on the outside of the inner envelope (2) and electrical connection of the coating (22, 23) to one (11) of the electrical conductors, and attachment of an outer envelope (18) to the tubular sections (6, 7) of the inner envelope (2) so that the outer envelope (18) encloses the discharge vessel (3) while leaving a cavity (20) between itself and the discharge vessel (3), the electrical conductor (11) being connected to the coating (22, 23) inside the outer envelope (18).

10. A method as claimed in claim 9, characterized in that a hole (21) is made in the tubular section (7) associated with the relevant electrical conductor (11) and the coating (22, 23) is electrically connected to the electrical conductor (11) through the hole (21).

11. A method as claimed in claim 10, characterized in that the hole (21) is made in the tubular section (7) with a laser.

12. A method as claimed in claim 10, characterized in that the hole (21) is made in the sealing section (9) of the tubular section (7) during a pinching process.

* * * * *